US009581380B1

(12) United States Patent
Quesada Saborio

(10) Patent No.: US 9,581,380 B1
(45) Date of Patent: Feb. 28, 2017

(54) FLEXIBLE REFRIGERATION PLATFORM

(76) Inventor: Carlos Quesada Saborio, San José (CR)

( * ) Notice: Subject to any disclaimer, the term of this patent is extended or adjusted under 35 U.S.C. 154(b) by 974 days.

(21) Appl. No.: 12/220,074

(22) Filed: Jul. 21, 2008

Related U.S. Application Data

(60) Provisional application No. 60/961,571, filed on Jul. 20, 2007.

(51) Int. Cl.
*F25D 19/00* (2006.01)
*F25D 23/00* (2006.01)

(52) U.S. Cl.
CPC ..... *F25D 23/006* (2013.01); *F25D 19/00* (2013.01)

(58) Field of Classification Search
CPC ..... F25D 23/00; F25D 23/006; F25D 19/00
USPC ..... 62/77, 298, 239, 259.1, 299, 302, 62/448–450
See application file for complete search history.

(56) References Cited

U.S. PATENT DOCUMENTS 3,000,193 A * 9/1961 Crider ..... 62/285
3,662,582 A 5/1972 French
3,692,100 A 9/1972 Gallagher, Jr.
4,186,474 A * 2/1980 Hine ..... 29/890.047
4,341,088 A 7/1982 Mei et al.
4,349,489 A 9/1982 Gaget
4,397,331 A 8/1983 Medlar
4,507,937 A * 4/1985 Bretz ..... 62/298
4,570,458 A * 2/1986 Avery, Jr. ..... 62/503
4,748,824 A * 6/1988 Wakabayashi et al. ..... 62/239
4,860,993 A 8/1989 Goode
4,971,139 A * 11/1990 Khattar ..... 165/86
5,024,419 A * 6/1991 Mulvey ..... 251/148
5,117,523 A * 6/1992 Jacobus et al. ..... 62/259.1
5,275,233 A * 1/1994 Little ..... 165/111
5,953,929 A * 9/1999 Bauman et al. ..... 62/259.1
5,960,637 A * 10/1999 Stevens et al. ..... 62/77
6,069,791 A * 5/2000 Goto et al. ..... 361/679.54
6,250,602 B1 6/2001 Jansen
6,260,373 B1 * 7/2001 Rockwood ..... 62/295
6,272,867 B1 8/2001 Barrash et al.
(Continued)

FOREIGN PATENT DOCUMENTS

DE 2209329 9/1972
DE 2209325 9/1973
(Continued)

*Primary Examiner* — Ryan J Walters
*Assistant Examiner* — Antonio R Febles
(74) *Attorney, Agent, or Firm* — James Creighton Wray; Meera P. Narasimhan

(57) ABSTRACT

In a new flexible-monoblock refrigeration configuration arrangement, all of the refrigeration components are gathered within its one and only flexible chassis platform. These units are one piece, meaning that their condenser, refrigerant control assemblies, compressor and the evaporator are fixed to their one and only integrated flexible chassis. No refrigeration components are outside its enclosure. There is no need to perform any assembling or service to the refrigeration itself at the time of installation. The new flexible monoblock refrigeration system can be configured in many different forms using parallel rigidly interconnected side plates. The sub platforms are rigidly connected to the side plates so that all of the weight, forces and stress are borne by the side plates and none is transferred among the refrigeration elements, units or subassemblies.

24 Claims, 19 Drawing Sheets

(56) References Cited

U.S. PATENT DOCUMENTS

| | | | | |
|---|---|---|---|---|
| 6,279,333 | B1 | 8/2001 | Cilli et al. | |
| 6,332,327 | B1 | 12/2001 | Street et al. | |
| 6,446,445 | B1 * | 9/2002 | Phillips et al. | 62/50.2 |
| 6,481,216 | B2 | 11/2002 | Simmons et al. | |
| 6,564,563 | B2 | 5/2003 | Goth et al. | |
| 6,637,452 | B1 | 10/2003 | Alman | |
| 6,644,056 | B2 | 11/2003 | Goth et al. | |
| 6,647,735 | B2 | 11/2003 | Street et al. | |
| 6,662,588 | B2 | 12/2003 | Houk et al. | |
| 6,688,125 | B2 | 2/2004 | Okamoto et al. | |
| 6,698,218 | B2 | 3/2004 | Goth et al. | |
| 6,742,343 | B2 | 6/2004 | Matonog et al. | |
| 6,848,670 | B2 | 2/2005 | Haunhorst | |
| 6,931,884 | B2 * | 8/2005 | Kolda et al. | 62/449 |
| 6,973,794 | B2 | 12/2005 | Street et al. | |
| 7,000,422 | B2 | 2/2006 | Street et al. | |
| 7,013,655 | B2 | 3/2006 | Des Champs | |
| 7,047,753 | B2 | 5/2006 | Street et al. | |
| 7,080,521 | B2 | 7/2006 | Ludwig et al. | |
| 7,228,691 | B2 | 6/2007 | Street et al. | |
| 7,254,956 | B2 | 8/2007 | Matonog et al. | |
| 7,260,946 | B2 | 8/2007 | Ludwig et al. | |
| 7,266,961 | B2 | 9/2007 | Ludwig et al. | |
| 7,270,278 | B2 | 9/2007 | Street et al. | |
| 7,320,225 | B2 | 1/2008 | Street et al. | |
| 7,406,834 | B2 | 8/2008 | Williams | |
| 7,448,409 | B2 | 11/2008 | Micheel | |
| 7,461,516 | B2 | 12/2008 | Leadingham et al. | |
| 2004/0159110 | A1 * | 8/2004 | Janssen | 62/77 |
| 2006/0117773 | A1 | 6/2006 | Street et al. | |
| 2006/0196208 | A1 * | 9/2006 | Zangari et al. | 62/298 |
| 2007/0125528 | A1 | 6/2007 | Fakheri | |
| 2007/0186569 | A1 | 8/2007 | Street et al. | |
| 2012/0160465 | A1 | 6/2012 | Webb | |

FOREIGN PATENT DOCUMENTS

| | | |
|---|---|---|
| DE | 3815647 | 12/1988 |
| DE | 202008006379 | 7/2008 |
| EP | 0640803 | 3/1995 |
| EP | 1840494 | 10/2007 |
| GB | 1390782 | 4/1975 |
| JP | 2002153931 | 5/2002 |
| JP | 2004218954 | 8/2004 |
| WO | WO 89/06774 | 7/1989 |

* cited by examiner

PRIOR ART

PRIOR ART

FLEXIBLE REFRIGERATION PLATFORM

This application claims the benefit of U.S. Provisional Application 60/961,571 filed Jul. 20, 2007, which is hereby incorporated by reference in its entirety.

BRIEF DESCRIPTION OF THE INVENTION

Refrigeration apparatuses are arranged basically in two ways: the monoblock and the SPLIT refrigeration configurations. That is a result of the way in which the different refrigeration components are associated and interconnected. There are four major components in refrigeration units: the condenser, the refrigerant control assemblies, the compressor, and the evaporator (FIG. 1). All of them are interconnected by the use of refrigerant lines. A complete refrigeration unit is considered to have two sectors: the heat rejecting sector and the heat absorbing sector (FIG. 2). These sectors can be interconnected into one integrated complete enclosure (FIG. 3) or they may be interconnected into separate remote enclosures (FIG. 4).

In the monoblock refrigeration configuration arrangement, all of the refrigeration components are gathered within a rigid chassis platform (FIG. 5).

Those units are one piece, meaning that their condenser, refrigerant control assemblies, compressor, and the evaporator are fixed to one rigid chassis and enclosure. No refrigeration components are outside the enclosure. All of the refrigeration components are interconnected by the use of rigid refrigerant lines (tubes). The heat rejecting sector and the heat absorbing sector are rigidly joined together in the same platform and enclosure, even though each sector has its own sub-housing (FIG. 6). This rigid characteristic of the MONOBLOCK refrigeration chassis platform and its refrigerant lines give that type of refrigeration unit one specific shape (FIG. 7).

These monoblock refrigeration machines may have several condensers, refrigerant control assemblies, compressors and evaporators, but the machines are still configured as one self-contained apparatus. Usually, these units are factory ready. They arrive to the end users charged and ready to go. There is no need to perform any assembling or service to the refrigeration unit itself at the time of installation. For example, that is the case with window residential air conditioning units, vending machines, large truck-trailer refrigeration units, maritime container refrigeration units and others. They have to be placed at the desired and correct location as one rigid piece of equipment (FIG. 8).

When those monoblock refrigeration equipment have various heat absorbing sectors, they are called multi-zone monoblock refrigeration units, because they still conform with one rigid platform and enclosure system (FIG. 9).

In the SPLIT refrigeration configuration arrangement, the refrigeration components are gathered within two or more rigid chassis platforms (FIG. 10).

The refrigeration components are arranged and assembled in various platforms and enclosures, dividing them into various separate rigid chassis and enclosures: the chassis and enclosure that contains the heat rejecting sector, and the chassis and enclosure that holds the heat absorbing sector. Usually, this type of refrigeration arrangement congregrates the condenser, the refrigerant control assemblies and the compressor as the components of the heat rejecting sector, leaving the evaporator assembly as the sole component of the heat absorbing sector.

The various separate rigid chassis platform and enclosure assembling are interconnected by either rigid or flexible refrigerant lines, tubes or hoses (FIG. 11).

Those elements, the separate platform enclosures and the non-integrated refrigerant lines give that type of refrigeration units the ability to be fixed or installed in a variety of different shape, surfaces or locations. This characteristic gives flexibility to the separate enclosures arrangement, not really to the separate platforms themselves. The various rigid platforms and enclosures could not be deformed into taking different shapes. Rather, the two or more interconnected pieces of equipment can be installed in a variety of different positions and applications, as various separate remote enclosures.

That split type of apparatus is not self contained. There is a need to perform a final assembling on site. At the least, the refrigerant lines must be installed at the premises (FIG. 12).

The split refrigeration units could have several condensers, refrigerant control assemblies, compressors and evaporators. That type of SPLIT configuration unit is called MULTI-SPLIT unit (FIG. 13). It means that the refrigeration equipment contains one heat rejection sector and several heat absorbing sectors. Even though the heat rejection sector may have several condensers, refrigerant control assemblies and compressors, it is still congregated as only one heat rejection platform and enclosure.

Examples of the split and multi-split refrigeration machines are: the air conditioning unit of an apartment with one, two or more rooms to be independently temperature controlled by only one remote refrigeration unit. The air conditioning apparatus of a city bus, where the heat rejecting sector (the condenser, the refrigerant control assemblies and the compressor platform and enclosure) is placed outside, underneath or in back of the bus. The heat absorbing sector, the evaporator platform and enclosure, is placed inside of the vehicle at the ceiling. In the refrigeration equipment of a perishable food delivery van, the heat rejecting sector is roof-top mounted outside the vehicle, and the heat absorbing sector is wall-mounted inside the cargo box.

Needs exist for improved refrigeration systems.

SUMMARY OF THE INVENTION

The new flexible refrigeration platform gives life to a totally new flexible-monoblock refrigeration unit configuration concept. The new system comes complete and ready to plug in and use. One unit may be configured in several ways. Requirements are eliminated for an inventory having several different configurations.

In the new flexible-monoblock refrigeration configuration arrangement, all of the refrigeration components are gathered within its one and only flexible chassis platform. These units are one piece, meaning that their condenser, refrigerant control assemblies, compressor, and the evaporator are fixed to their one and only integrated flexible chassis. No refrigeration components are outside its enclosure. There is no need to perform any assembling or service to the refrigeration itself at the time of installation.

This invention provides a totally new concept of a flexible-monoblock refrigeration configuration arrangement. Instead of fixing the refrigeration components into one rigid integrated platform, or into various rigid separate platforms, the present invention fixes them into one "flexible" integrated platform (FIG. 14).

The new invention takes the traditional four different groups of refrigeration components, and assigns them individual sub-platforms (FIG. 15) that are connected by new flexible refrigerant lines (FIGS. 16-17), conforming a new flexible refrigeration platform (FIG. 18).

The condenser, the refrigerant control assemblies, the compressor and the evaporator (all of them individually) are conforming independent groups that are fixed or attached into sub-platforms of the new flexible refrigeration platform by means of the implementation of a new flexible chassis that at the same time, houses the new flexible refrigerant lines that interconnects all of the refrigeration components.

In the new flexible-monoblock refrigeration units (FIG. 19), the new flexible chassis and the new flexible refrigerant lines (these two new essential elements) give these types of unit the ability of adjusting themselves to a large variety of different shape applications as a single, integrated, new flexible enclosure resulting in one flexible piece of equipment (FIG. 20) capable of conforming plural shapes (FIG. 21).

The new flexible monoblock refrigeration system can be configured in many different forms using parallel rigidly interconnected side plates. The sub platforms for mounting major elements are shown in FIG. 15. The sub platforms are rigidly connected to the side plates so that all of the weight, forces and stress are borne by the side plates and none is transferred among the refrigeration elements, units or subassemblies.

Reconfiguration is shown in FIG. 20 of the rigid flexible monoblock shown in FIG. 14-19.

The different reconfigurations shown in the second line of FIG. 21 allow the subassembly sub platforms identified in FIG. 15 to be rigidly connected to the different rigid parallel side plates shown in the top line of FIG. 21.

Condenser fans f are also connected to the rigid frames above the condensers, as shown in the bottom line in FIG. 21. Blowers are mounted on the rigid side plates near the evaporators.

The Flexible Monoblock has one chassis that is reconfigured in many shapes. The subassembly platforms are not limited to currently available best technology in compressors, condensers and evaporators. As new technological advances are made, new compressors, condensers and evaporators may be mounted on the subassembly sub platforms as indicated in FIG. 15.

The sub platforms are connected to rigid parallel mounting side plates. In some embodiments the elements are connected directly to the side plate. Nothing loads or stresses the parts. The drivers are mounted directly on the compressor sub platform.

The side plates and rigid interconnections are connected by frames directly to the trailer truck box or bus body with simple connections so that the entire refrigeration units may be removed and replaced.

Exterior and interior covers are attached to the trailer, truck or bus. The covers stay with the truck. Only the refrigeration units are removed and replaced.

The refrigeration units are available in four different width sizes in two different heights.

The side elevations show the ends of refrigerant lines, which are long U-shaped tubes. The long legs of the tubes twist as the monoblock chassis is reconfigured.

FIG. 22 schematically shows the subassemblies mounted between side plates, which are called side fixing plates. The side fixing plates are connected to surrounding fixing frames which are connected to the truck or vehicle body t. The outside cover and the inside cover are connected to the truck body t.

FIGS. 23, 24 and 25 are side, top and perspective views of the Flexible Monoblock refrigeration system.

FIGS. 23 and 24 show the Flexible Monoblock system before the condensers are attached.

FIG. 25 shows condensers installed in the Flexible Monoblock system which has been reconfigured.

The subassemblies s.a. may be separated along lines A, B, C and D in FIG. 23 and rearranged.

The disclosure of copending U.S. patent application Ser. No. 12/214,403 filed Jun. 18, 2008, now U.S. Pat. No. 7,614,242, is incorporated by reference herein as if fully reproduced herein.

These and further and other objects and features of the invention are apparent in the disclosure, which includes the above and ongoing written specification, with the drawings.

DETAILED DESCRIPTION OF THE DRAWINGS

Figure 1:
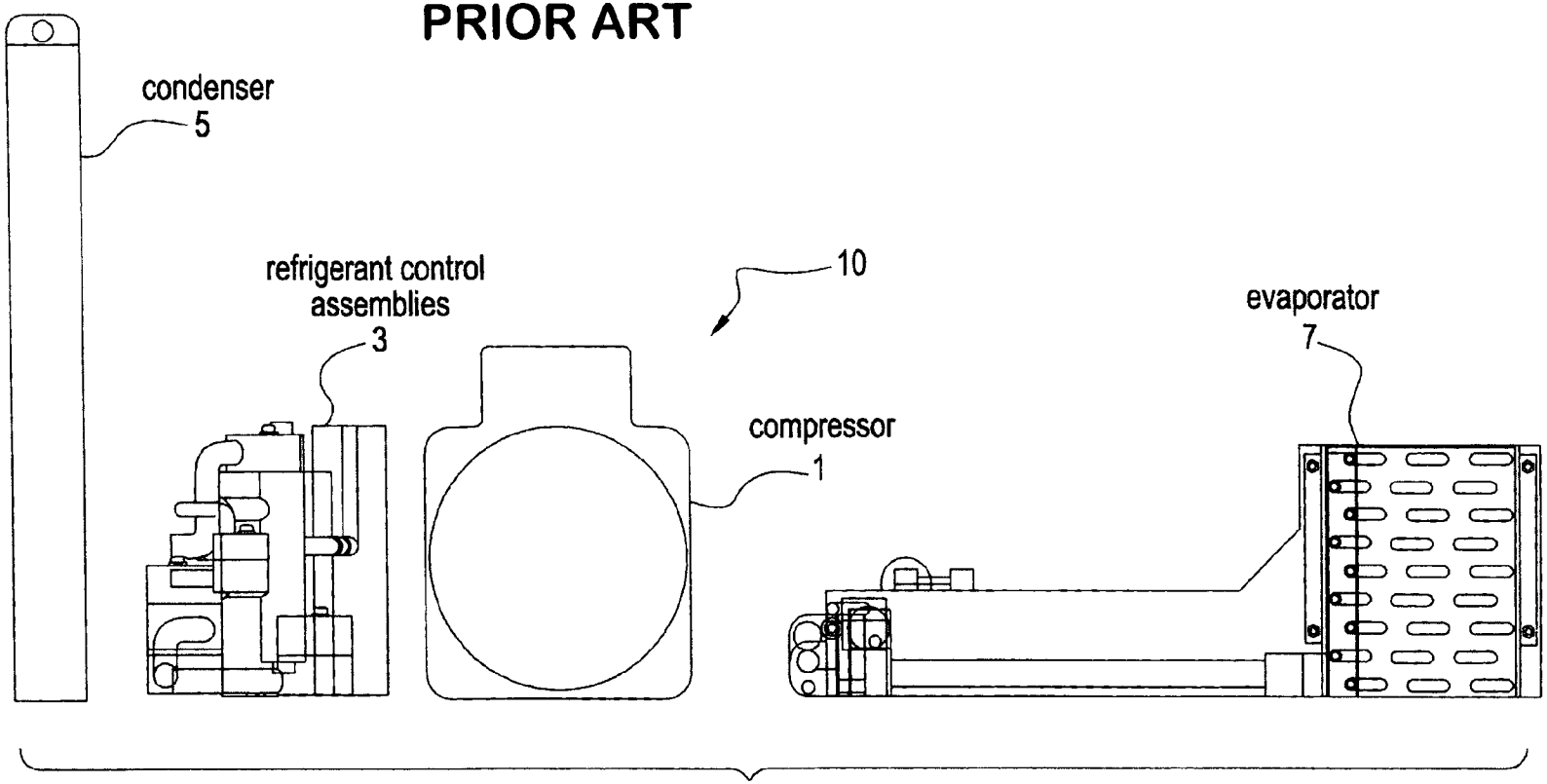
FIG. 1 shows refrigeration components.

FIG. 1 shows refrigeration components 10, including compressor 1, refrigerant control assemblies 3, condenser 5 and evaporator 7.

Figure 2:
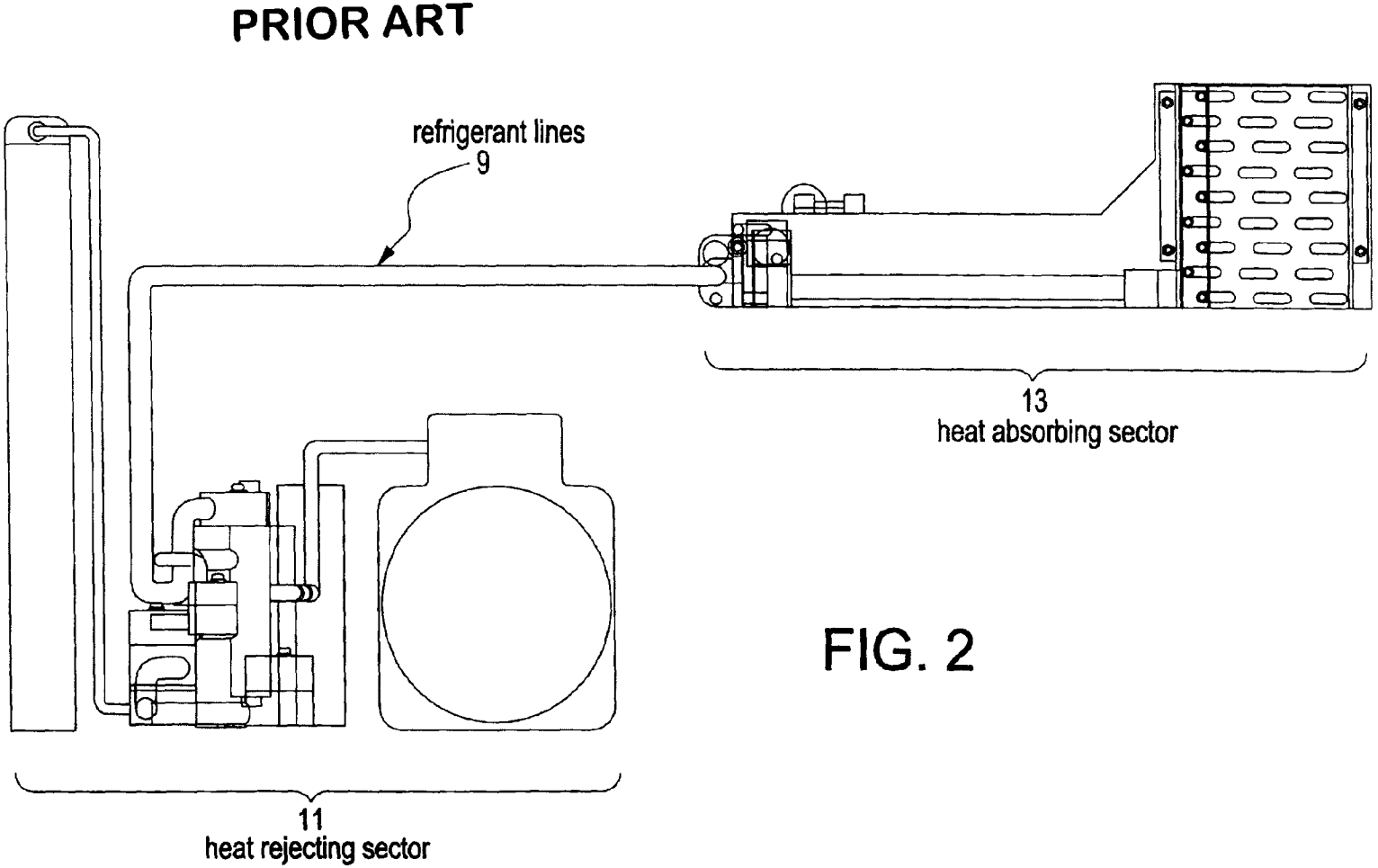
FIG. 2 shows the components of FIG. 1 connected in a heat rejection sector and a heat absorbing sector.

FIG. 2 shows the components of FIG. 1 connected by refrigerant lines 9 in a heat rejection sector 11 and a heat absorbing sector 13.

Figure 3:
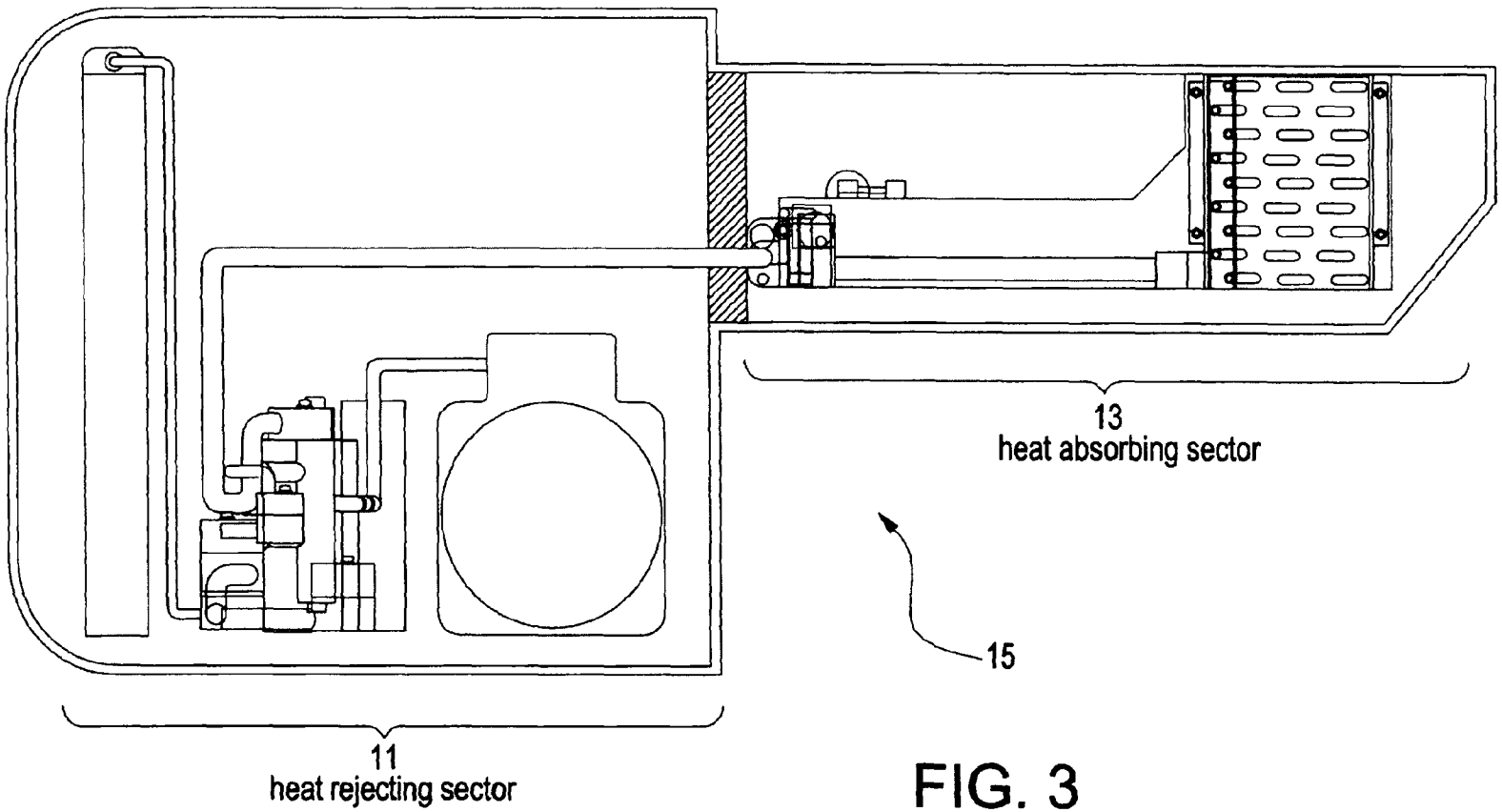
PRIOR ART FIG. 3
FIG. 3 shows the components of FIGS. 1 and 2 integrated and fixed in one complete unit.

FIG. 3 shows the components of FIGS. 1 and 2 integrated and fixed in one complete unit 15.

Figure 4:
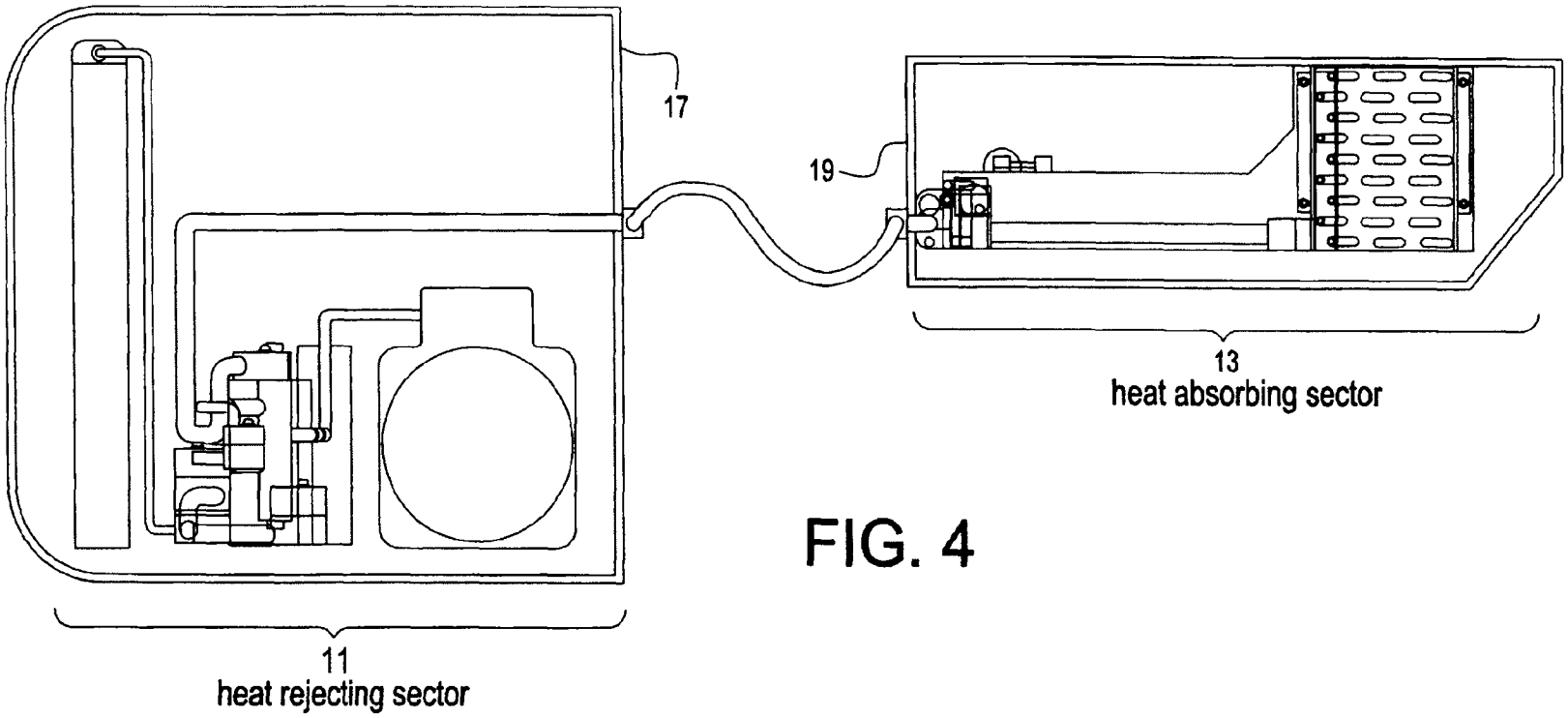
PRIOR ART FIG. 4
FIG. 4 shows the components of FIGS. 1 and 2 in two separate remote enclosures.

FIG. 4 shows the components of FIGS. 1 and 2 in two separate remote enclosures 17,19.

Figure 5:
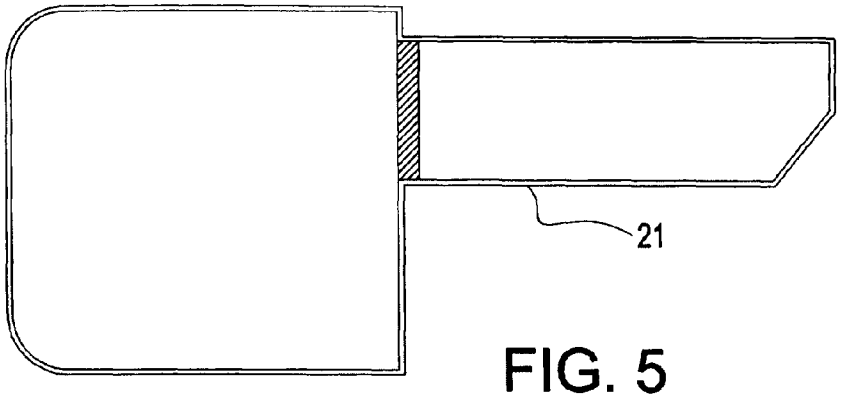
PRIOR ART FIG. 5
FIG. 5 shows one rigid refrigeration enclosure.

FIG. 5 shows one rigid refrigeration enclosure 21.

Figure 6:
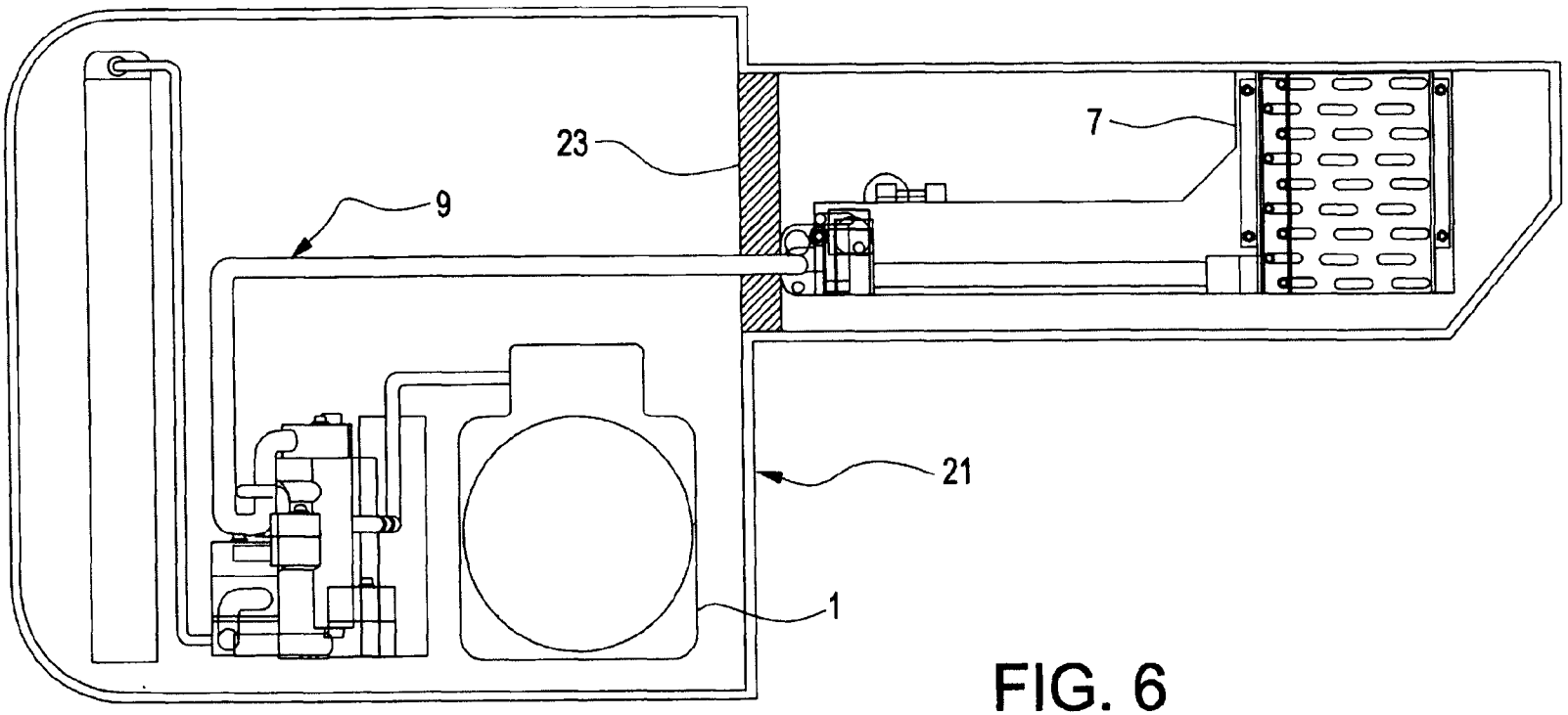
PRIOR ART FIG. 6
FIG. 6 shows refrigeration components in one rigid refrigeration enclosure.

FIG. 6 shows refrigeration components, separated by an insulating wall 23 in one rigid refrigeration enclosure 21.

Figure 7:
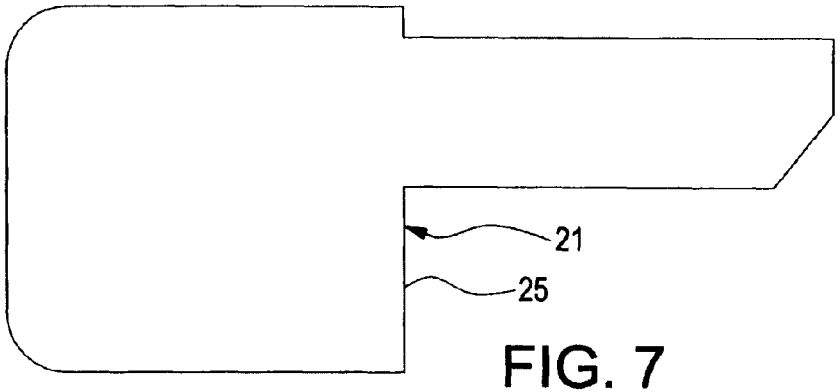
PRIOR ART FIG. 7
FIG. 7 shows one specific shape of the enclosure in FIGS. 3, 5 and 6.

FIG. 7 shows one specific shape 25 of the enclosure 21 in FIGS. 3, 5 and 6.

Figure 8:
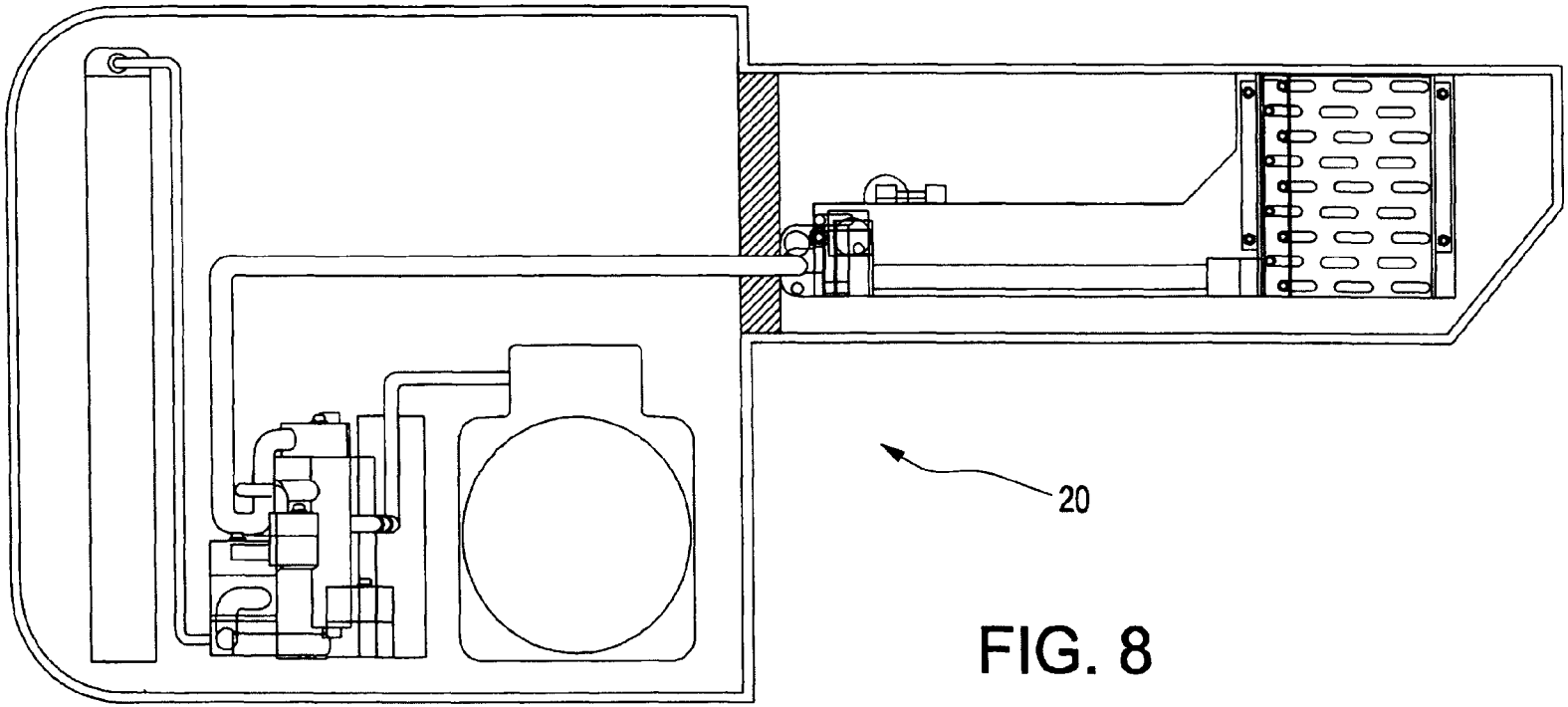
FIG. 8 PRIOR ART
FIG. 8 shows a complete monoblock refrigeration unit, such as shown in FIGS. 3 and 5.

FIG. 8 shows a complete monoblock refrigeration unit 20, such as shown in FIGS. 3 and 5.

Figure 9:
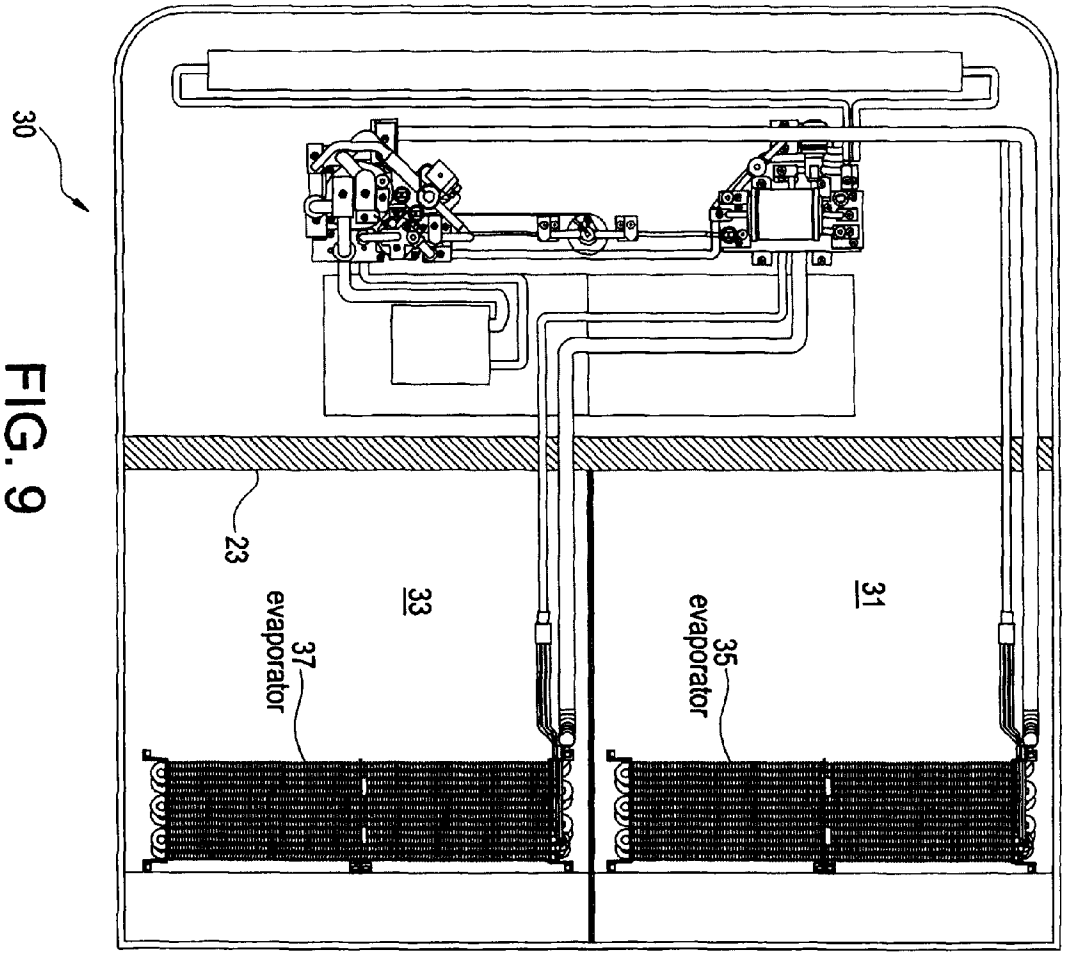
FIG. 9 is a top plan view of a multizone monoblock refrigeration unit.

FIG. 9 is a top plan view of a multizone monoblock refrigeration unit 30 with two separate zones 31, 33 with independent evaporators 35,37.

Figure 10:
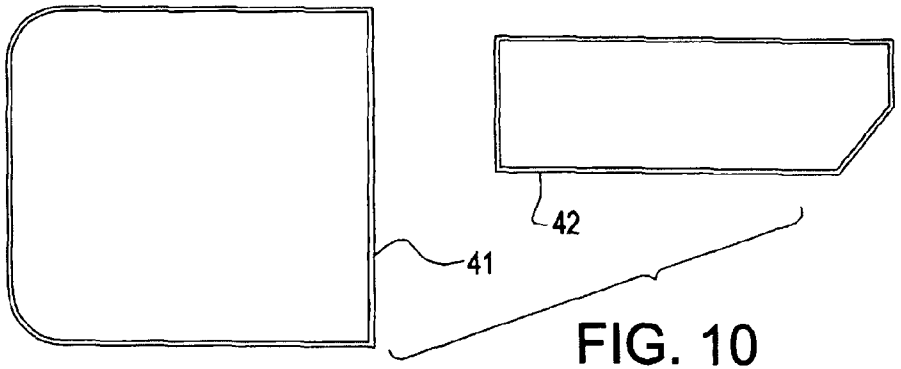
FIG. 10 PRIOR ART
FIG. 10 shows separate rigid chassis platforms.

FIG. 10 shows separate rigid chassis platforms 41,42.

Figure 11:
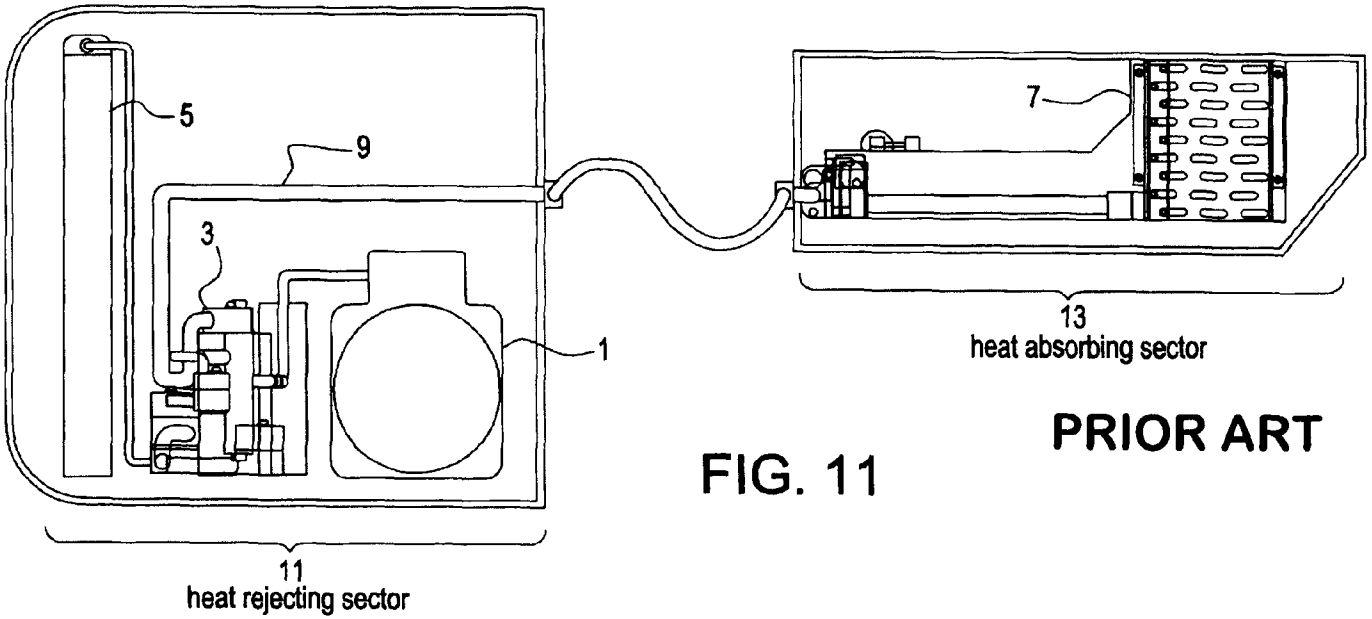
FIG. 11 PRIOR ART
FIG. 11 shows refrigeration components in a heat rejecting sector and a heat absorbing sector in separate rigid chassis platforms.

FIG. 11 shows refrigeration components 1, 3, 5, 7 in a heat rejecting sector 11 and a heat absorbing sector 13 in separate rigid chassis platforms.

Figure 12:
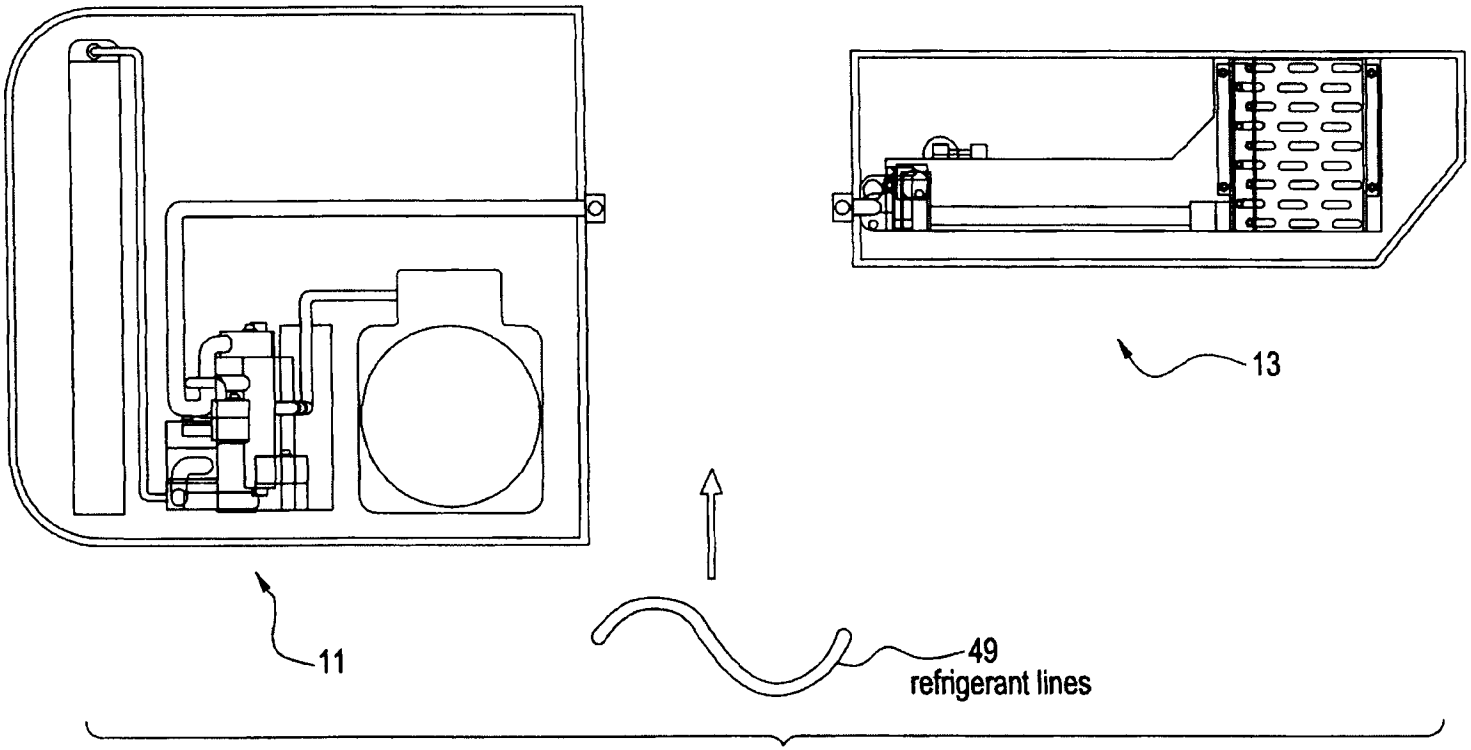
PRIOR ART FIG. 12
FIG. 12 shows the separate sectors and separate refrigeration lines.

FIG. 12 shows the separate sectors and separate refrigeration lines 49.

Figure 13:
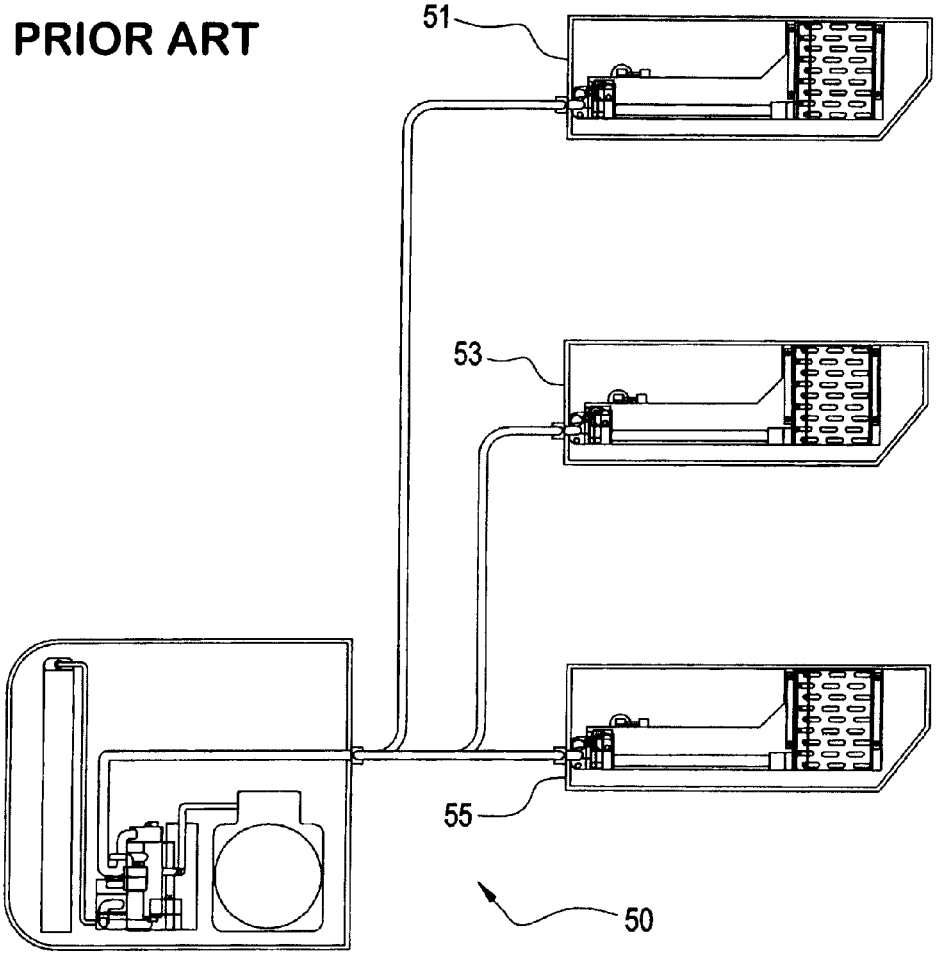
FIG. 13 shows multiple heat absorbing sectors in a multiple split refrigeration unit.

FIG. 13 shows multiple heat absorbing sectors 51,53,55 in a multiple split refrigeration unit 50.

Figure 14:
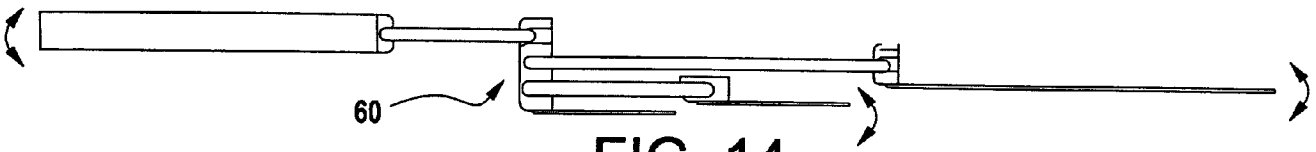
FIG. 14 shows one flexible integrated platform.

FIG. 14 shows one flexible integrated platform 60.

Figure 15:
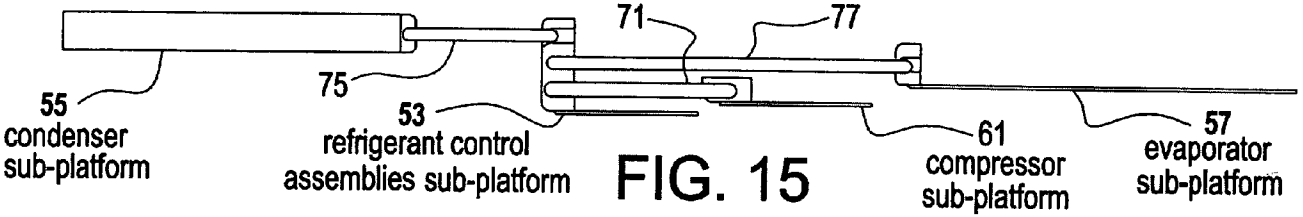
FIG. 15 identifies the refrigerant component sub platforms.

FIG. 15 identifies the refrigerant component sub platforms, compressor sub platform 61, refrigerant control assemblies sub platform 63, condenser sub platform 65 and evaporator sub platform 67.

Figure 16:
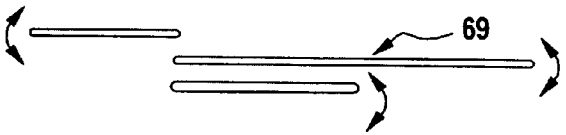
FIG. 16 shows side views of new flexible refrigerant lines.

FIG. 16 shows side views of new flexible refrigerant lines 69.

Figure 17:
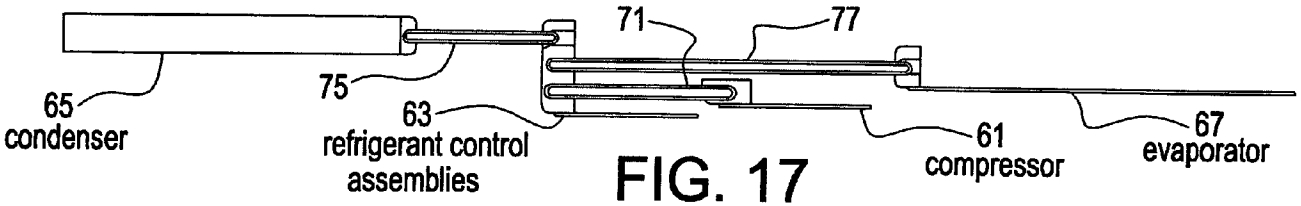
FIG. 17 shows the multiple sub platforms connected by the new flexible refrigerant lines.

FIG. 17 shows the multiple sub platforms connected by the new flexible refrigerant lines 69 including lines 71, lines 75 and lines 77.

Figure 18:
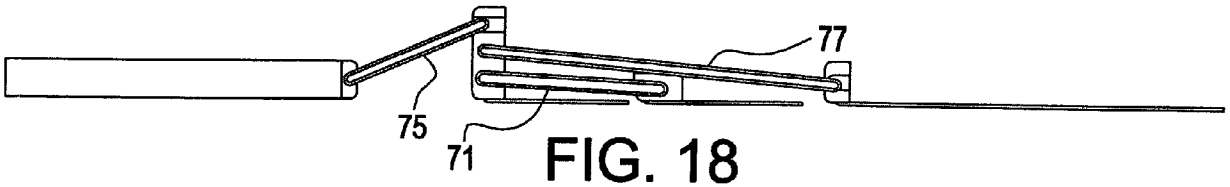
FIG. 18 shows repositioning of the multiple sub platforms connected by the new flexible refrigerant lines as shown in FIG. 17.

FIG. 18 shows repositioning of the multiple sub platforms connected by the new flexible refrigerant lines as shown in FIG. 17 lines 71,75,77 and platforms 61,63,65,67.

Figure 19:
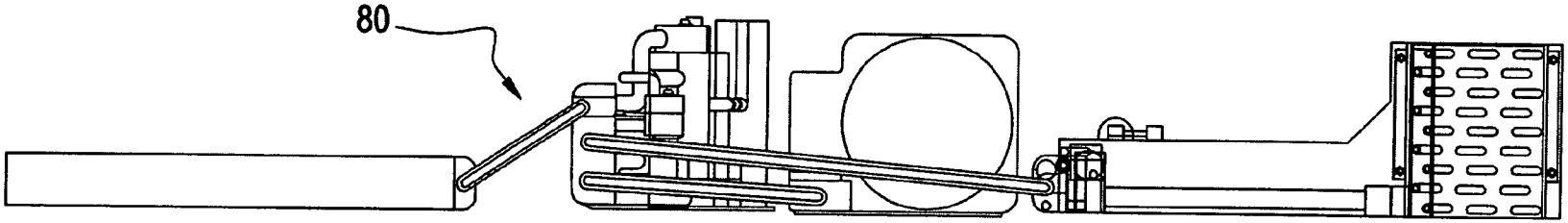
FIG. 19 shows the new flexible monoblock refrigeration system.

FIG. 19 shows the new flexible monoblock refrigeration system 80.

Figure 20:
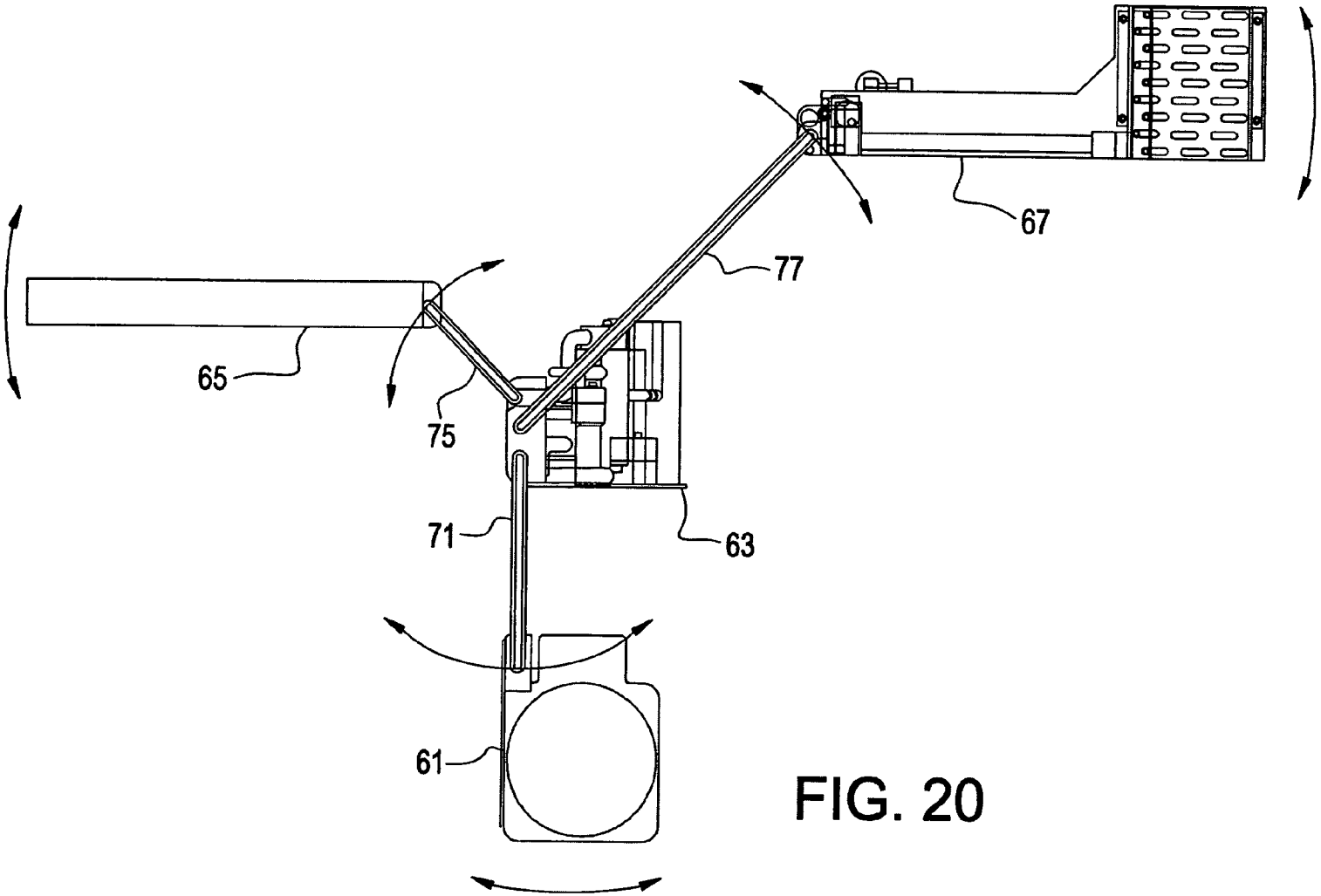
FIG. 20 shows flexible relocation of the sub platforms.

FIG. 20 shows flexible relocation of the sub platforms 61,63,65,67.

Figure 21:
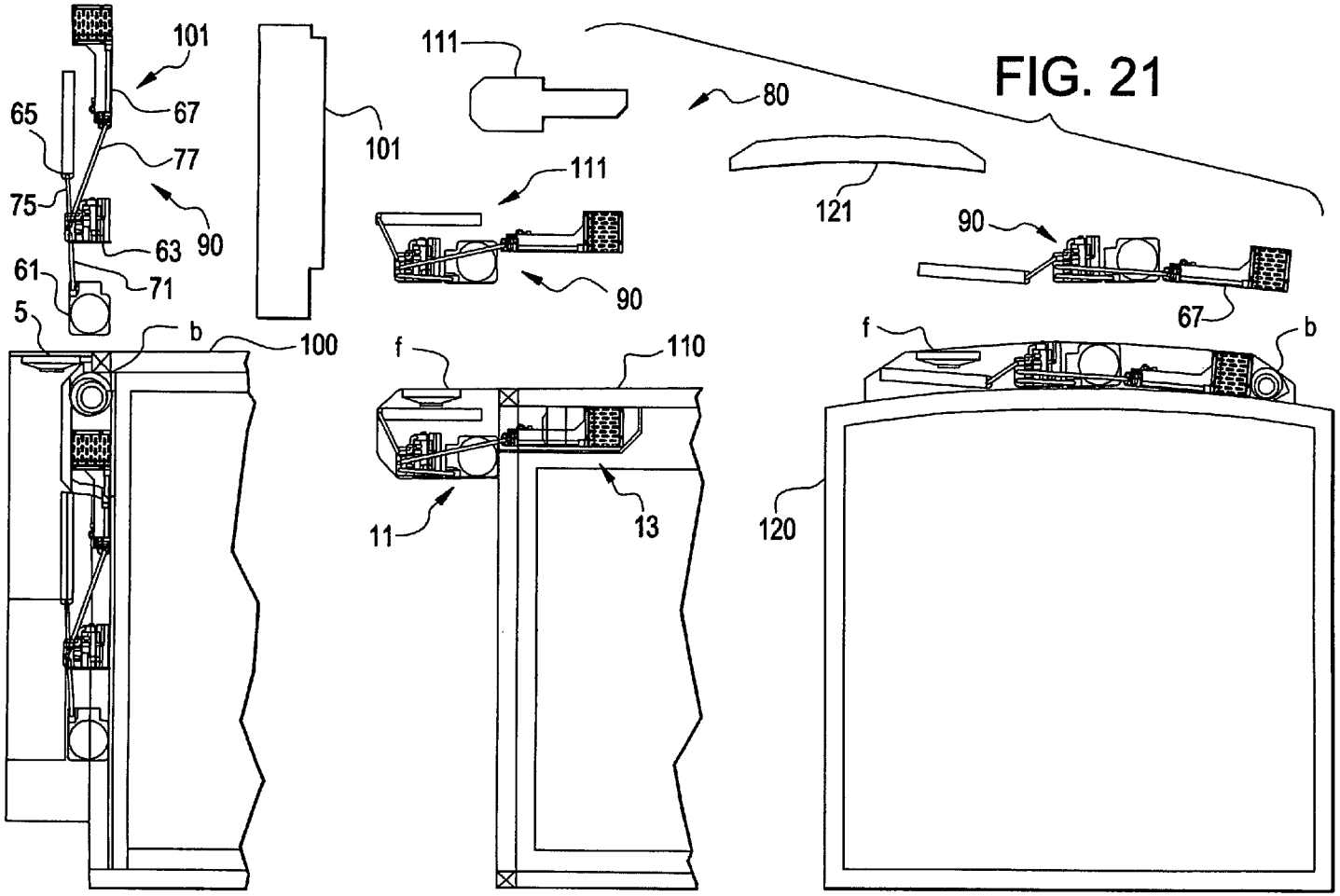
FIG. 21 shows examples of varied shapes and configurations of the new refrigeration system.

FIG. 21 shows examples of varied shapes and configurations of the new refrigeration system 80. A refrigerated semi trailer container body 100 may have a vertical configuration 101 with component platforms 61,63,65,67 in the system 80 arranged vertically and connected with lines 71,75 and 77. Fan f blows air through condenser 76, and blower b recycles refrigerated air through the body 100. A refrigerated straight truck container body 110 may have a horizontally configured 111 system. The heat rejecting sector 11 is mounted outside the body 110, and the heat absorber unit 13 is mounted inside the body.

The flexible monoblock system 90 is the same in both trucks. Only the flexible configuration has been rearranged.

The flexible monoblock system 90 mounted on a passenger vehicle 120 has a curved horizontal rooftop configuration 121 in which sub platforms 61,63,65,67 are mounted. Fan f blows air through condenser platform 71, and blower b circulates cooled air in the interior of the passenger vehicle 120.

Figure 22:
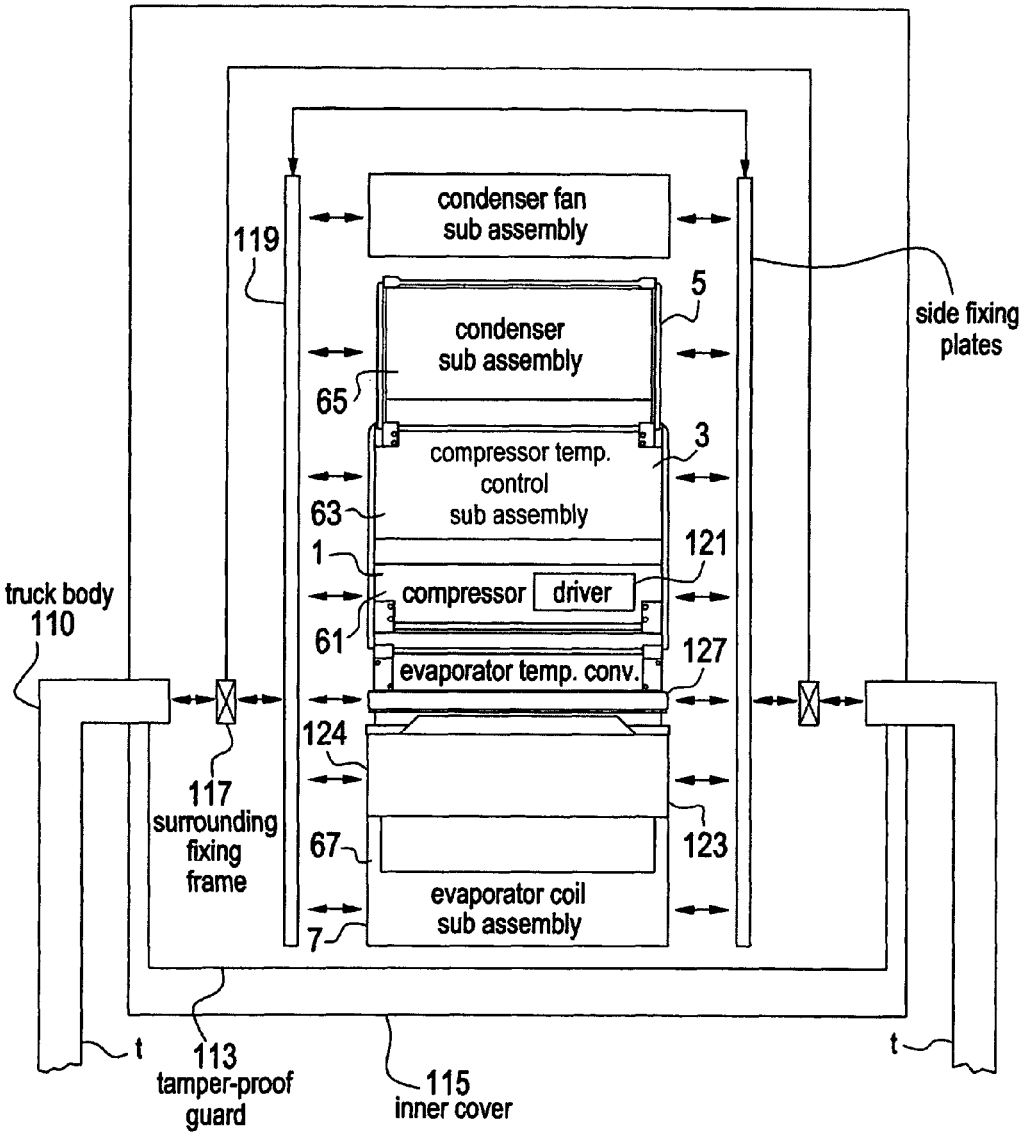
FIG. 22 is a plan view of the new refrigeration system in a track body.

FIG. 22 is a plan view of the new refrigeration system in a truck body 110 in configuration 111, as shown in FIG. 21. The truck body t has a heavy wire tamper proof guard 113 which prevents access to contents of the body while the refrigeration unit is being removed and replaced. An inner cover 115 directs cooled air through the body. Surrounding fixing frame 117 is connected between the truck body t and the side fixing frames 119 which hold the component sub platforms 61,623,65,67, on which the refrigeration components are mounted.

Compressor 1 and a compressor driver motor 121 are mounted on the compressor platform 61. The temperature control sub assembly 3 is mounted on the control platform 63. The condenser sub-assembly 5 is mounted on the condenser platform 65. The evaporator temperature control sub-assembly 123 may be mounted on platform 65 or on a separate platform 124. The evaporator coil sub-assembly 7 is mounted on the evaporator platform 67. Insulating wall 127 is mounted between the side fixing plates 119 to separate the chilled evaporator 7 from the outside heat rejection components.

Figure 23:
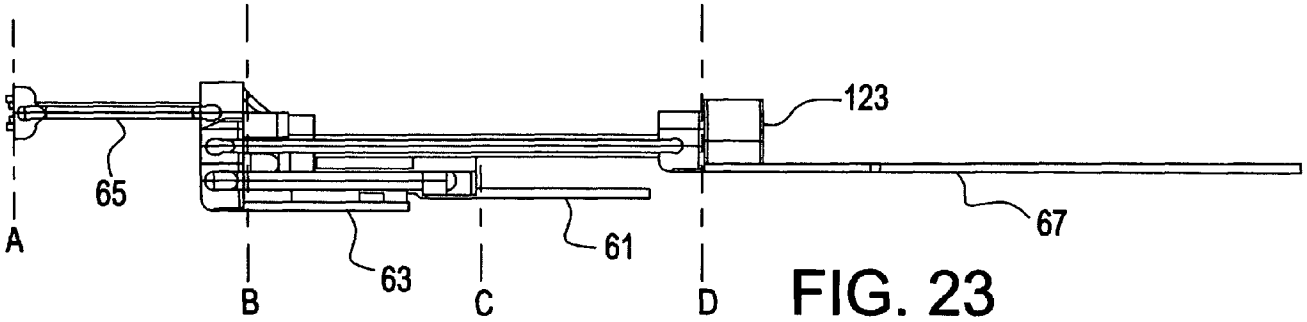
FIG. 23 schematically shows the separation of the flexible sub platforms.

FIG. 23 schematically shows the separation of the flexible sub platforms 61,63,65,67 along lines A, B, C and D.

Figure 24:
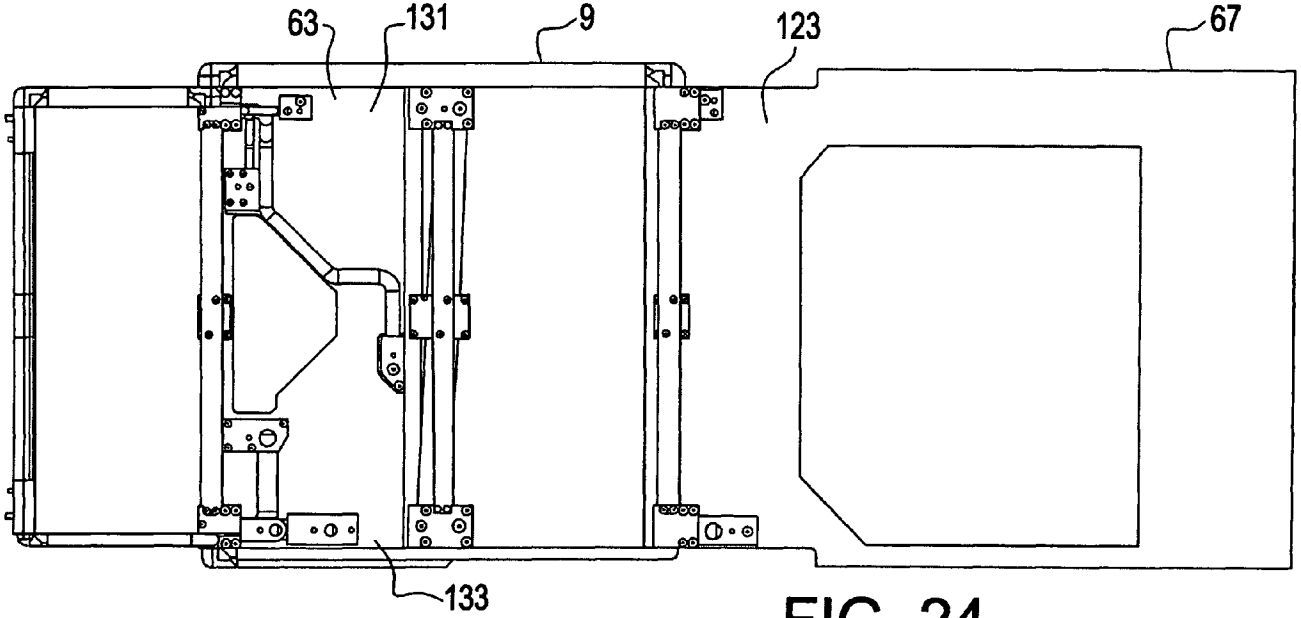
FIG. 24 is a plan view showing the sub platforms for the sub assemblies.

FIG. 24 is a plan view showing the sub platforms for the sub assemblies. The liquid control sub-assembly 131 and the vacuum control sub-assembly 133 are mounted on the control sub platform 63. The evaporator temperature control sub-assembly 123 is shown mounted on the evaporator platform 67. The refrigerant lines 9 are connected at ends to refrigeration components. The lines first extend across the full width of the platform then extend to the next platform and across the full width of the next platform before connected the line to the next sub-assembly. Twisting in the lines occurs as they extend across the width of the platforms so that the line portions extending between the platforms do not twist or bend while the sub platforms are being moved to different configurations.

Figure 25:
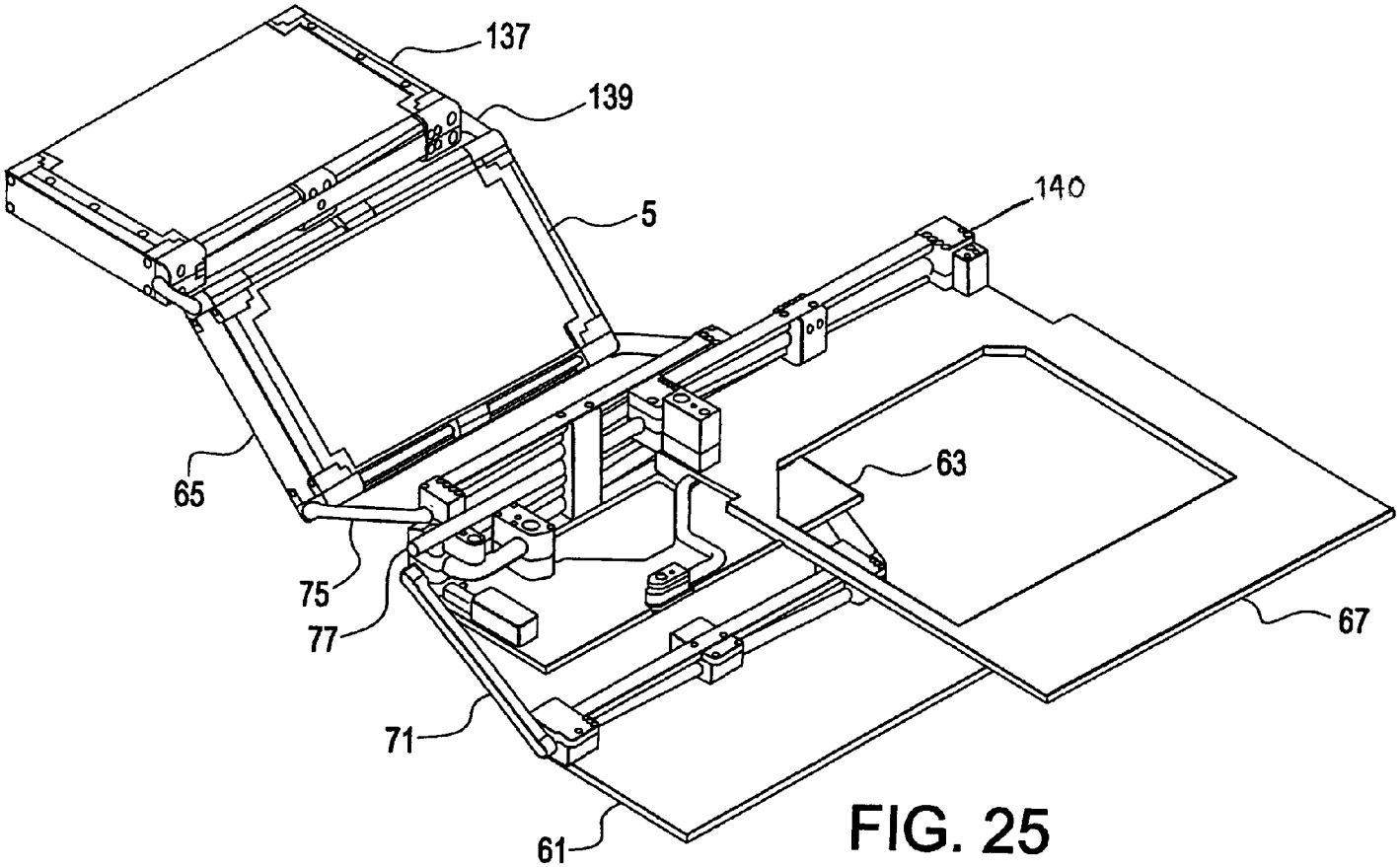
FIG. 25 shows one configuration of the flexible assembly platforms.

FIG. 25 shows one configuration of the flexible assembly platforms 61,63,65,67 and refrigerant lines 71,75,77. The condenser sub platform supports condenser 5 and a second condenser part 137 which is connected by refrigerant lines 139 to condenser 5. The compressor and driver mounting platform tray 61, refrigeration control sub platform 63, condenser platform 65 and evaporator tray platform 67 are interconnected by the refrigerant lines 69 and 139.

In one embodiment, such as shown in FIG. 25, the platforms 61,63,65,67 have fixed refrigerant line connectors 140 attached thereto. The connectors are affixed to the platforms and to ends of the flexible refrigerant lines 69. The connectors have ports 141 for connection to the refrigeration components 1,3,5,7.

When the sub platforms 61,63,65,67 are moved to different positions, the fixed refrigerant line connectors 140 prevent the component connectors from moving or being stressed.

The fixed connectors clamp ends of the refrigerant lines to the platform. The line connectors along the edges of the platforms have two aligned openings. One opening clamps an end of a line. The other opening is a guide opening that allows a portion of another line to pass through the connector while keeping the portion of the other line alignment with the width of the platform.

Figure 27:
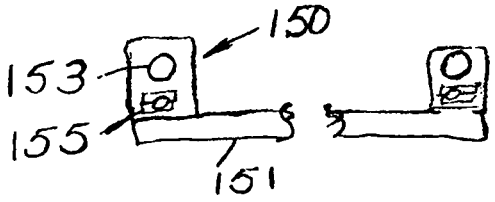
FIG. 27 is a schematic representation of blocks attached to a platform with opening for passing free ends of the refrigerant lines.
Figure 28:
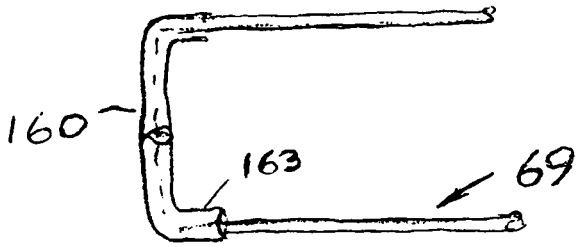
FIG. 28 is a schematic representation of a cover or sleeve on part of a U-shaped line.

In one embodiment, as shown in FIG. 28, tubes 160 having ends bent at right angles cover the refrigerant lines extending between the platforms to prevent bending of the lines. The bent ends 163 of the tubes extend into the guide openings 153 of the blocks 150 shown in FIG. 27 and act as bearings, preventing chafing of the refrigerant lines in the guide openings.

Figure 26:
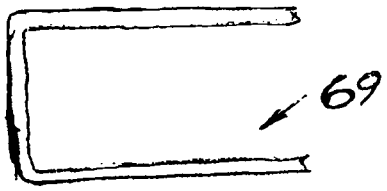
FIG. 26 is a schematic representation of a U-shape refrigerant line.

FIG. 26 shows a U-shape refrigerant line 69.

FIG. 27 shows blocks 150 attached to a platform 151 with openings 153 for passing free ends of the refrigerant lines and clamps 155 for fixed ends of the refrigerant lines.

FIG. 28 shows a tube 160 covering a middle part of a U-shaped line.

Figure 29:
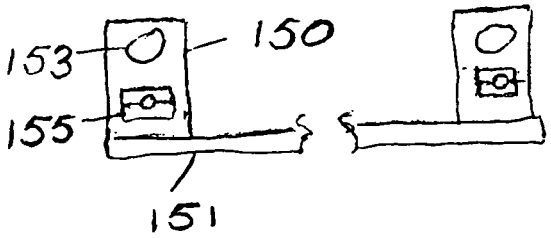
FIG. 29 is a schematic representation of clamps in the blocks for holding fixed ends of the U-shaped refrigerant line.

FIG. 29 shows clamps 155 in the blocks 150 for holding fixed ends of the U-shaped refrigerant lines.

While the invention has been described with reference to specific embodiments, modifications and variations of the invention may be constructed without departing from the scope of the invention.

I claim:

1. A refrigeration system comprising a hermetically sealed refrigerant system, separated refrigeration component platforms, flexible and hermetically sealed refrigeration lines connected to the platforms, refrigerant components separately mounted on the platforms and connected and hermetically sealed to ends of the refrigerant lines on the platforms, the platforms being radially repositionable, the refrigerant lines being hermetically sealed to the refrigeration components, and when repositioning the platforms radially with respect to other platforms the refrigeration components or their connections are not stressed, wherein the hermetically sealed refrigerant lines comprise rectangular U-shaped lines having middle portions and parallel leg portions, the middle portions extending between the platforms and the leg portions extending freely rotatably through guide openings near sides of the platforms, the leg portions further extending from the guide openings across the platforms and terminating in fixed end portions on the platforms, the fixed end portions being hermetically connected to the refrigeration components on the platforms, wherein the leg portions of the hermetically sealed refrigerant lines are twistable between the fixed end portions and guide openings about longitudinal axes as the platforms are moved radially relative to each other.

2. The refrigeration system of claim 1, wherein the refrigeration component platforms comprise a compressor and driver platform, a refrigerant control assemblies platform, a condenser platform and an evaporator platform.

3. The refrigeration system of claim 1, further comprising blocks connected to the platforms, the blocks having the guide openings for receiving the leg portions of the hermetically sealed refrigerant lines near junctions of the leg portions with the middle portions and having opposite combined fixed connectors and guides for connecting the ends of the legs to the refrigeration components and guiding the legs connected to opposite connections and guides.

4. The refrigeration system of claim 1, wherein the platforms are moved to a vertical configuration for semi trailers, to a horizontal configuration for standard trucks and to a curved, horizontal position for passenger vehicles and buses.

5. The refrigeration system of claim 1, further comprising blocks connected near side edges of the platforms, the blocks to the platforms and having the guide openings for receiving the leg portions near the middle portions and having end connectors for fixing the ends and hermetically connecting ends of the legs to the refrigeration components.

6. A refrigeration system comprising plural individual refrigeration component platforms, flexible and hermetically sealed refrigerant lines mounted on the platforms and interconnecting the platforms, the refrigerant lines comprising tubes having middle and leg portions, the middle portions extending between platforms and the leg portions extending at right angles from the middle portions pass freely through guide openings on sides of the platforms, the leg portions further extending across the platforms and terminating in fixed end portions on the platforms, the end portions having ends hermetically connected to refrigeration components on the platform wherein the leg portions are twistable between the fixed end portions and the guide openings as the platforms are moved relative to each other.

7. A refrigeration system comprising plural individual refrigeration component platforms, flexible and hermetically sealed refrigerant lines mounted on the platforms and interconnecting the platforms, the refrigerant lines having middle and leg portions, the middle portions extending between platforms and the leg portions extending from the middle portions pass freely through guide openings on the platforms, the leg portions further extending across the platforms and terminating in fixed end portions on the platforms, the end portions having ends hermetically connected to refrigeration components on the platform wherein the leg portions are twistable as the platforms are moved relative to each other, further comprising first and second blocks connected to the platforms the blocks having the guide openings for receiving the leg portions near the middle portions of the lines, and the blocks having end connectors adapted for hermetically connecting the ends of the legs to refrigeration components mounted on the platforms and near sides of the platforms, the fixed end portions being hermetically connected to the refrigeration components on the platforms, wherein the leg portions of the hermetically sealed refrigerant lines are twistable between the fixed end portions and guide openings about longitudinal axes as the platforms are moved radially relative to each other.

8. The refrigeration system of claim 7, wherein the refrigeration component platforms comprise a compressor and driver platform, a refrigerant control assemblies platform, a condenser platform and an evaporator platform.

9. The refrigeration system of claim 7 wherein the middle portions are outside of the sides of the platforms.

10. A refrigeration system comprising a hermetically sealed refrigerant system, separated refrigeration component platforms, flexible and hermetically sealed refrigeration lines connected to the platforms, refrigerant components separately mounted on the platforms and connected and hermetically sealed to ends of the refrigerant lines on the platforms, the platforms being radially repositionable, the refrigerant lines being hermetically sealed to the refrigeration components, and when repositioning the platforms radially with respect to other platforms the refrigeration components or their connections are not stressed, wherein the refrigerant lines further comprise U-shaped refrigerant lines having middle portions and first and second spaced parallel leg portions, the leg portions further comprising first and second ends, the first ends being connected to opposite ends of the middle portions the legs extending freely through guide openings in blocks on sides of the platforms and the second ends of the leg portions being permanently fixed to refrigerant line connectors on other sides of the platforms whereby the leg portions extend between opposite sides of the platforms from second fixed ends to first ends freely rotatable in the guide openings.

11. The refrigeration system of claim 10 wherein the middle portions are outside of the sides of the platforms.

12. The refrigeration system of claim 10 wherein each of the blocks has a guide opening and a refrigerant line connector at different positions in the block.

13. A refrigeration system comprising separated refrigeration component platforms, sealed U-shaped refrigerant lines connected to the platforms, refrigerant components separately mounted on the platforms and connected and sealed to ends of the U-shaped refrigerant lines on the platforms, the platforms being radially repositionable, the refrigerant lines when repositioning the platforms radially with respect to other platforms the refrigerant components and their connections are not stressed, the refrigerant lines are tubes having middle and leg portions, the middle portions extending between platforms, and the leg portions extending at right angles from the middle portions and extending freely through guide openings mounted near sides of the platforms, the leg portions further extending across the platforms and terminating in fixed and sealed end portions on the platforms, wherein the leg portions are free to twist between the fixed ends and the guide openings as the platforms are moved radially relative to each other.

14. A method comprising:

providing a refrigeration system, providing a separated refrigeration component platforms, providing guide openings near sides of the platforms, providing flexible and sealed refrigerant lines connected to the platforms, each of the refrigerant lines is a tube having a U-shape with spaced parallel leg portions extending from a middle portion freely through the guide openings, providing refrigerant components separately mounted on the platforms and directly connected and hermetically sealed to remote ends of the leg portions of the refrigerant lines on the platforms, providing the platforms being radially repositionable, wherein the refrigerant lines have remote ends hermetically sealed to the refrigerant components and the leg portions are twistable between the fixed ends and the guide openings for repositioning the platforms radially with respect to other platforms the refrigerant components or their connections are not stressed.

15. A method according to claim 14, wherein the refrigeration component platforms comprise a compressor and driver platform, a refrigerant control assemblies platform, a condenser platform and an evaporator platform.

16. A method comprising:

providing a refrigeration system, the refrigeration system further comprising providing a separated refrigeration component platforms, providing flexible and sealed refrigerant lines connected to the platforms, providing refrigerant components separately mounted on the platforms and directly connected and sealed to ends of the refrigerant lines on the platforms, providing the platforms being radially repositionable, wherein the refrigerant lines being sealed and twistable for repositioning the platforms radially with respect to other platforms the refrigerant components or their connections are not stressed, wherein the refrigerant lines comprise rectangular U-shaped lines having middle and leg portions, the middle portions extending between platforms and the leg portions extending freely through guide openings, the leg portions further extending from the guide openings across the platforms and terminating in fixed end portions on the platforms, wherein the leg portions are twistable about longitudinal axes as the platforms are moved radially relative to each other.

17. A method according to claim 16, wherein the platforms are moved to a vertical configuration for semi trailers, to a horizontal configuration for standard trucks and to a curved, horizontal position for passenger vehicles and buses.

18. A method comprising:

providing a refrigeration system, the refrigeration system further comprising providing a separated refrigeration component platforms, providing flexible and sealed refrigerant lines connected to the platforms, providing refrigerant components separately mounted on the platforms and directly connected and sealed to ends of the refrigerant lines on the platforms, providing the platforms being radially repositionable, wherein the refrigerant lines being sealed and twistable for repositioning the platforms radially with respect to other platforms the refrigerant components or their connections are not stressed, further comprising blocks connected to the platforms, the blocks having the guide openings for receiving the leg portions near the middle portions and having opposite combined fixed connectors and guides for connecting ends of the legs to the refrigeration components and guiding legs connected to opposite connections and guides.

19. An apparatus comprising refrigeration lines directly connecting refrigeration components, further comprising refrigeration component platforms, blocks mounted on the refrigerant component platforms, the blocks having aligned openings mounted at sides of the refrigeration component platforms, U-shaped lines, the U-shaped refrigerant lines comprising tubes having middle portions and having legs extending at right angles from the middle portions, the leg portions extending across the refrigeration component platforms and middle portions of the refrigerant lines extending between the refrigeration component platforms, the legs having fixed ends fixed to the refrigerant components near sides of the platforms and the legs having free ends opposite the fixed ends, the free ends extending through openings in the blocks near opposite sides of the platforms, the middle portions of the refrigerant tubes extending along sides of the refrigeration component platforms and between the free ends of legs of the U-shaped refrigerant lines, wherein when the platforms are translated relative to adjacent platforms, the middle portions of the tubes are rotated around the free ends of the legs and between the platforms while the legs are twisted longitudinally between the free ends and the fixed ends without moving the fixed ends, wherein the middle portions do not twist or bend while the platforms are being moved to different positions.

20. The apparatus of claim 19, further comprising tubes covering portions of the refrigerant lines.

21. The apparatus of claim 19, further comprising tubes covering the middle portions of the refrigerant lines.

22. The apparatus of claim 19, further comprising tubes covering the middle portions of the refrigerant lines and the turnable ends of the legs, and wherein the tubes extend through the openings in the block.

23. Refrigeration apparatus comprising repositionable refrigeration component platforms, further comprising the blocks mounted near opposite sides of the repositionable refrigeration component platforms, the blocks having aligned openings, U-shaped refrigerant lines having legs, and middle portions directly connecting the legs, the legs having fixed ends fixed to the refrigeration components near sides of the platforms, the legs extending across the platforms and having free ends opposite the fixed ends, the free ends extending through openings in the blocks, the middle portions of the refrigerant tubes extending between the free ends of the refrigerant lines and extending between the platforms along and near sides of the platforms, wherein when the platforms are translated relative to adjacent platforms, the middle portions of the tubes are rotated between the components around the free ends of the legs and the legs are twisted longitudinally between the turnable ends and the fixed ends without turning the fixed ends.

24. A refrigeration system comprising a hermetically sealed refrigerant system, separated refrigeration component platforms, flexible and hermetically sealed refrigeration lines connected to the platforms, refrigerant components separately mounted on the platforms and connected and hermetically sealed to ends of the refrigerant lines on the platforms, each of the refrigerant lines is a tube having a U-shape with leg portions extending at right angles from a middle portion, the leg portions extending freely rotatably through guide openings near sides of the platforms, the leg portions further extending from the guide openings across the platforms and having fixed ends fixed to the refrigerant components on the platforms, the platforms being radially repositionable, the fixed ends of the refrigerant lines being hermetically sealed to the refrigeration components, and when repositioning the platforms radially with respect to other platforms the long leg portions of the refrigerant lines being twistable, whereby the refrigeration components and their connections are not stressed as the platforms are moved radially relative to each other.

* * * * *